United States Patent [19]

DiMatteo et al.

[11] Patent Number: 4,718,133

[45] Date of Patent: Jan. 12, 1988

[54] COLLAPSIBLE TUB—IN AN INVALID BED ARRANGEMENT

[75] Inventors: Paul DiMatteo, Huntington; Charles F. Chubb, Brookville, both of N.Y.

[73] Assignee: Med Bed Technologies, Inc., Hauppauge, N.Y.

[21] Appl. No.: 767,515

[22] Filed: Aug. 20, 1985

Related U.S. Application Data

[63] Continuation-in-part of Ser. No. 731,533, May 7, 1985.

[51] Int. Cl.[4] ..... A61G 7/08

[52] U.S. Cl. ..... 5/81 R; 5/81 B; 5/61

[58] Field of Search ..... 4/588, 595; 5/60, 61, 5/81 R, 83, 81 C, 88, 453, 455, 465

[56] References Cited

U.S. PATENT DOCUMENTS

| | | | |
|---|---|---|---|
| 378,220 | 2/1888 | Staples et al. | 5/81 B |
| 716,886 | 12/1902 | Goode | 5/81 B |
| 942,606 | 12/1909 | Wilson | 5/81 B |
| 1,793,006 | 2/1931 | O'Neill | 5/60 |
| 3,810,263 | 5/1974 | Taylor et al. | 5/81 R |
| 4,068,326 | 1/1978 | Deschler | 4/588 |
| 4,285,541 | 8/1981 | Onishi | 5/81 R |

FOREIGN PATENT DOCUMENTS

| | | | |
|---|---|---|---|
| 0005555 | 11/1979 | European Pat. Off. | 5/60 |
| 716981 | 1/1942 | Fed. Rep. of Germany | 5/60 |

*Primary Examiner*—Gary L. Smith
*Assistant Examiner*—Michael F. Trettel
*Attorney, Agent, or Firm*—Max Fogiel

[57] ABSTRACT

An arrangement for transferring a supine patient longitudinally or laterally between beds or surfaces adapted to accept the patient in a supine position. The arrangement is adapted to function with a conventional or hospital-type bed. It includes apparatus for transferring a collapsible bathtub or a bedsore prevention pad onto said bed and transferring a patient onto and off these devices.

29 Claims, 39 Drawing Figures

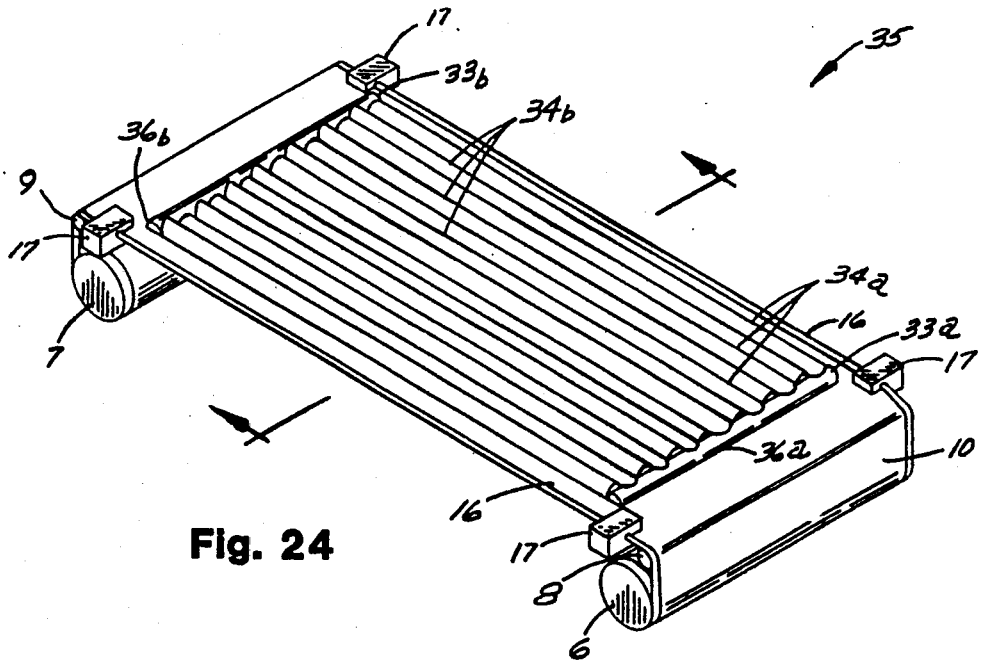
Fig. 24
Fig. 25
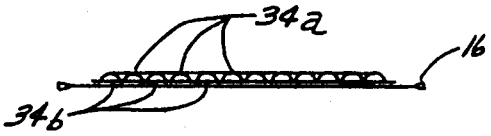
Fig. 26
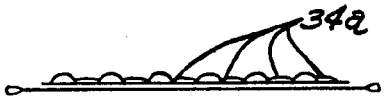
Fig. 27
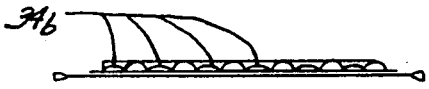
Fig. 28
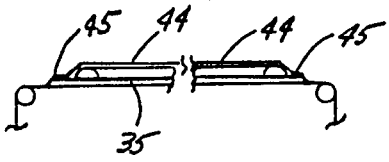

COLLAPSIBLE TUB—IN AN INVALID BED ARRANGEMENT

BACKGROUND OF THE INVENTION

The present application is a continuation-in-part of the parent application Ser. No. 731,533 filed May 7, 1985.

The process of transferring an invalid person from a hospital bed to a wheelchair, to a commode, or to a bathtub in a hospital, nursing home, or home, or assisting such a person in such a transfer, often involves more than one person, is labor intensive and can be costly. The task frequently requires considerable strength and is occasionally a source of injury to the invalid person or attendant. Further, the task of periodically moving or turning a patient to prevent decubitus ulcers (bedsores) is arduous and fatiguing. These problems often are the major factors that cause a person to be hospitalized or moved to a nursing home, rather than being cared for at home. They also increase the cost of caring for persons in hospitals and nursing homes.

Principal objects of this present invention are to provide a novel arrangement of parts or attachments which can be added and attached to existing or new beds or designed into new beds which will significantly assist in:

(A) the transfer of a person or patient from one bed to a reclining wheelchair or other surface;

(B) the transfer of a person or patient to and from a "tub" arrangement for bathing of said patient;

(C) the transfer of a person or patient to and from a pad surface designed to automatically vary the pressure or reduce the pressure on a person's skin to prevent decubitus ulcers;

(D) the removal and replacement of soiled bed sheets.

Objects A and D have have been the subject of previous inventions. The present invention comprises improvements which address objects B, C and D.

Additional objects and advantages of the present invention will become more evident from the following description of specific embodiments when read in conjunction with the accompanying drawings.

BRIEF DESCRIPTION OF THE DRAWINGS

FIG. 24 is a perspective view of a bedsore preventor part of this invention;

FIGS. 25 through 27 are elevation views of the bedsore prevention pad in operating sequence;

FIG. 28 is an elevation view of the bedsore prevention pad with a cover sheet;

DESCRIPTION OF THE PREFERRED EMBODIMENTS

For the purpose of describing the operation of the present invention, the patient is considered to be transported in a longitudinal (head to foot) direction from the bed to the other surface, and to return in the opposite direction (foot to head). This is done for the convenience of the discussion only, and it will be clear that the invention may be designed to move the patient in a lateral or side-to-side motion with the transfer apparatus located on the left and right sides of the bed rather than at the head and foot ends as illustrated and described. It is not intended that the invention be limited to end-to-end, or longitudinal, transfer.

Figure 23:
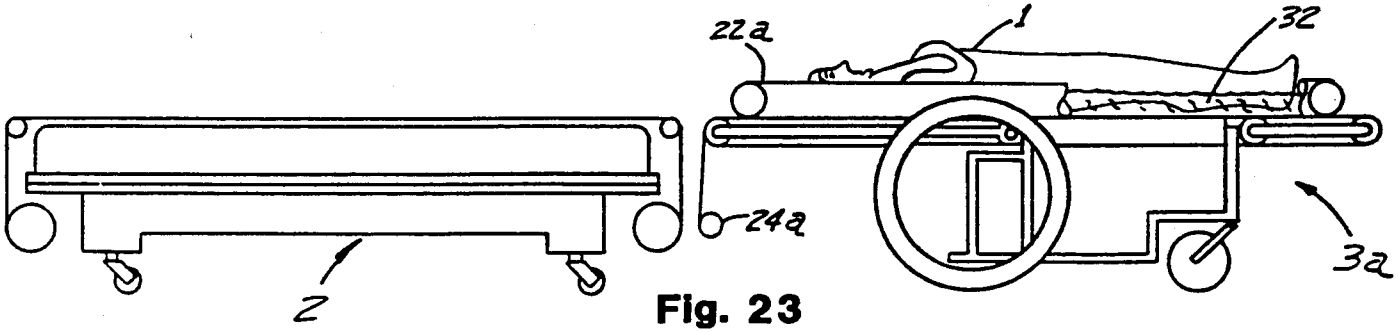

Two transfer operations are required to prepare a patient for a bath in accordance with this present invention. The first is to transfer the patient from the bed 2 to a reclining wheelchair or other suitable surface. This transfer procedure, which is the subject of other inventions, is summarized schematically in FIGS. 9, 10, and 11. The second transfer procedure, which is the subject of the present invention, is to transfer the patient and a collapsed bathtub together onto the bed so that the patient is placed on the surface of the bathtub as shown schematically in FIGS. 12 and 13 and variously through FIG. 23.

Figure 1A:
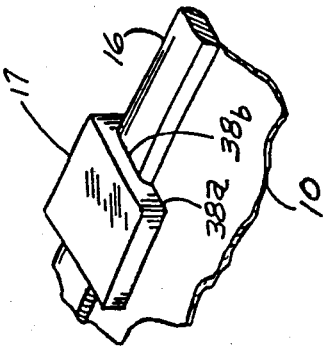
FIG. 1*a* is an enlarged perspective view of a portion in FIG. 1.
Figure 1:
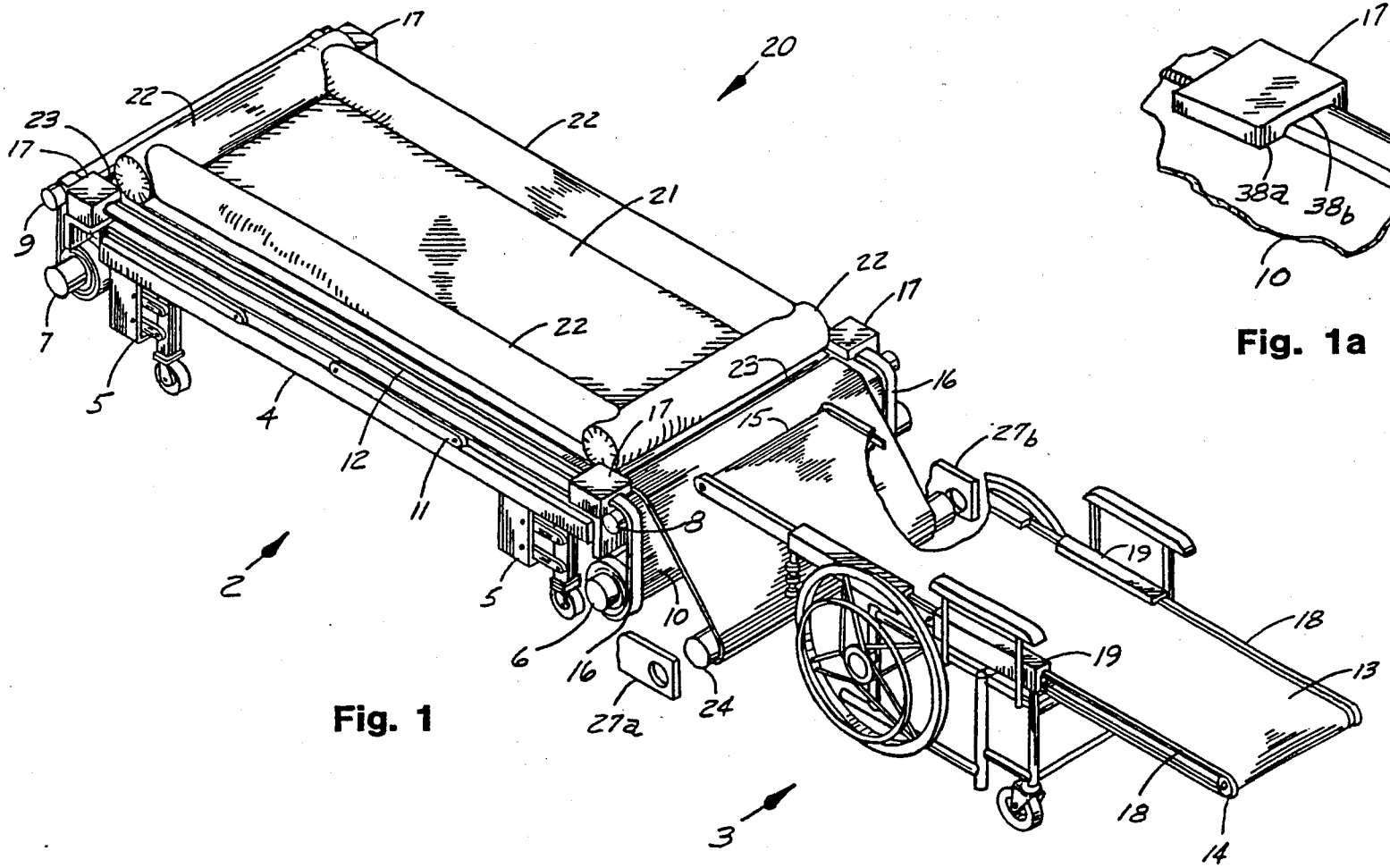
FIG. 1 is a perspective view of the essential elements of this invention.

FIG. 1 is a perspective view of the equipment in a preferred embodiment of the present invention.

Figure 9:
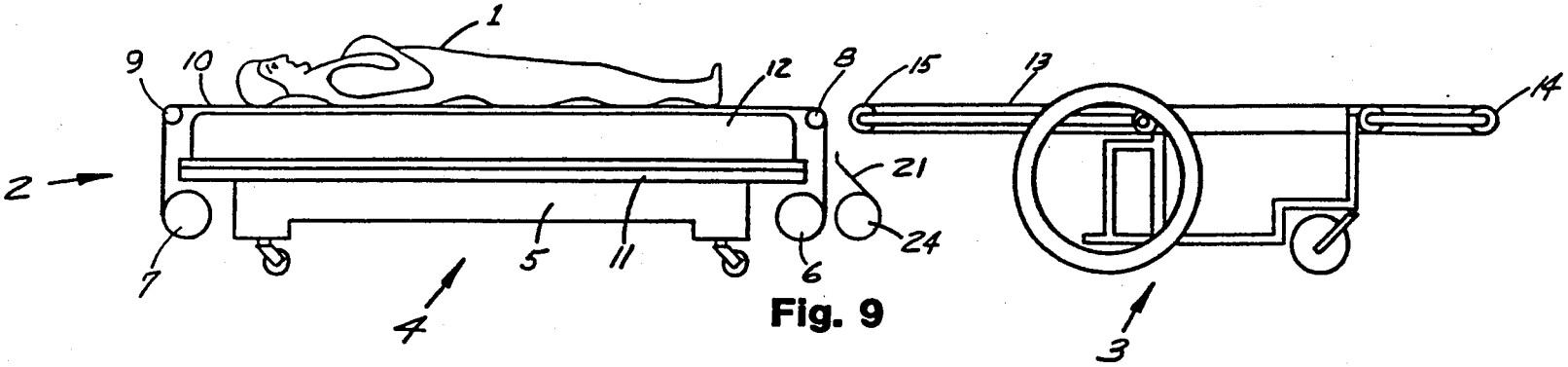
FIGS. 9 through 14 are schematic sequenced views showing the operation of this invention using the bathtub apparatus stored at the foot end of the bed.

FIGS. 1 and 9 show the bed 2, which consists of a conventional bed 4 as found in a home or an institution such as a hospital or nursing home. An elevating device 5, either manual or power driven, as found on hospital-type beds, is used to raise or lower the bed 2 to the proper height, to perform the required operations. Alternatively, the bed may be blocked up to the proper height and left there for the duration of the patient' use.

Also attached to the conventional bed 4 is an arrangement for transporting a person from a position on the bed to and beyond the edge of the bed. This arrangement contains a foot-end roller 6 whose length is approximately equal to the width of the bed, and which is mounted to the bed frame at the foot end of the bed. A similar head-end roller 7 is positioned at the head end of the bed. A specially designed bed sheet 10, approximately equal in width to the width of the bed and equal in length to several multiples of the length of the bed, is fastened to and partially rolled up on the foot or near end roller 6 while the other end is fastened to the head or far end roller 7 at the head end of the bed.

Although not a requirement of this invention, it is desirable to keep the length of the modified bed 2 as short as possible. For this reason, the rollers 6 and 7 are located under the main bed frame members 11. To ease the transport of the sheet 10 over the mattress 12, a foot-end-corner idler roller 8 and head-end-corner idler roller 9 are mounted to the bed frame 11. These idler rollers 8 and 9 can be of relatively small diameter and covered with a soft material over a stiff core to enable comfortable patient transfer over them. The top surface of these rollers is approximately level with the top surface of the bed 2.

Mechanical power sources such as, but not limited to, electric motors or hand cranks (not shown) are provided for driving the two rollers to wind up the sheet 10 on one roller while allowing it to unwind from the other so as to move the sheet over the surface of the mattress 12 and thereby transport a reclining person 1 from a position on the bed 2 to and beyond the end of the bed.

The wheelchair 3, shown in FIGS. 1, 9, 10 and 11 at the foot end of the bed 2, is in a reclining position. A mechanism, not shown, allows the wheelchair 3 to assume this reclining position. Alternatively, any surface suitably equipped as described below may be used in place of the wheelchair. The bed 2 is adjusted by mechanism 5 to the same height as the wheelchair 3.

The wheelchair 3 is equipped with rollers 14 and 15, one on each end. Fastened around these rollers 14 and 15 is a sheet of material 13 which extends over the top surface of the wheelchair 3 and back under the chair as an endless belt. Provision (not shown) is made to apply proper tension to this sheet 13 and to propel it around rollers 14 and 15 by mechanical means such as a motor or hand crank. Alternatively, the wheelchair 3 (or other suitable surface) may have rollers with a sheet fastened between them as in the manner of the bed 2 described above. The transfer operation of the wheelchair apparatus is similar to that of the bed apparatus, with the ability to transport a patient onto or off the surface.

Figure 10:
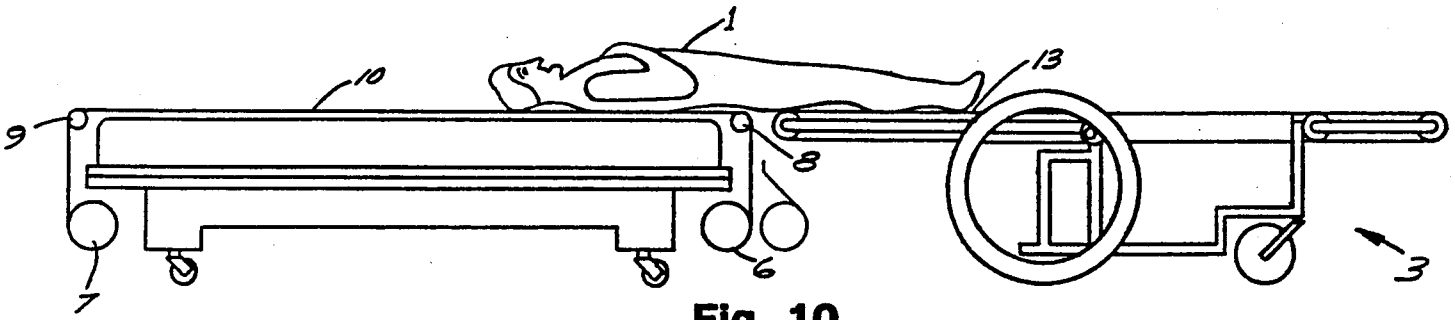
Figure 11:
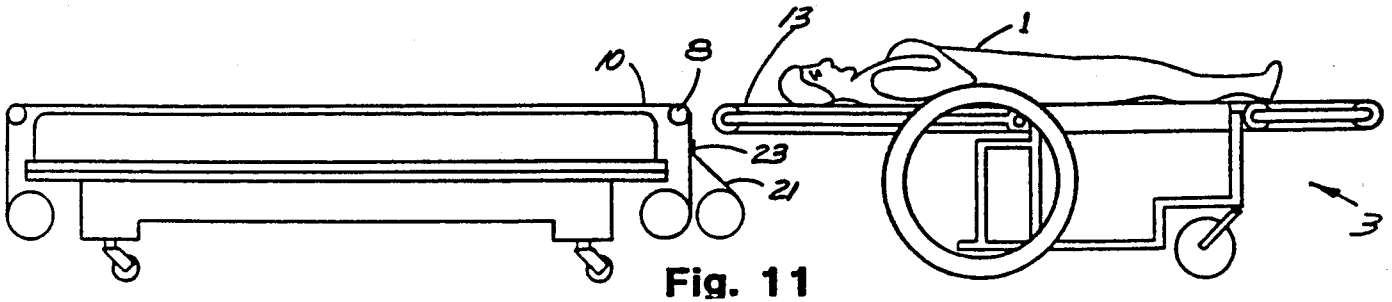
Figure 12:
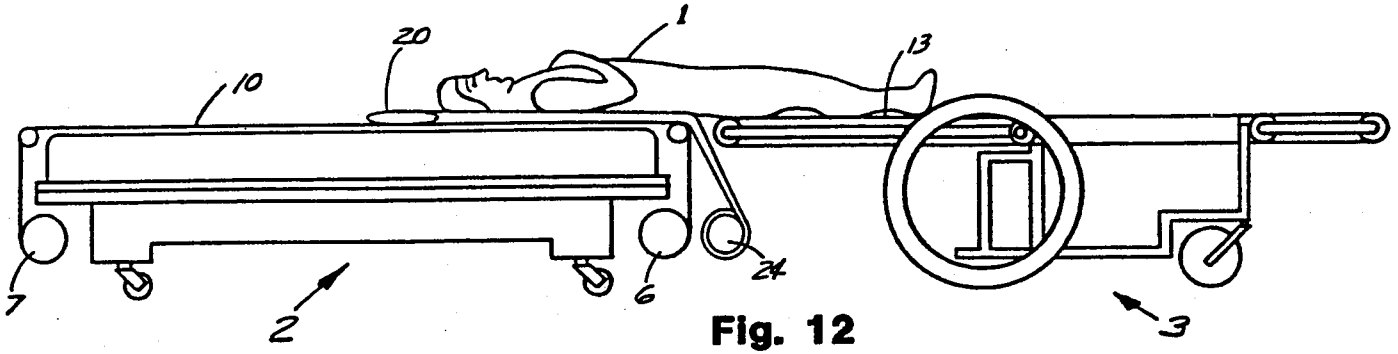

FIGS. 10 and 11 show the transfer of a person 1 from bed 2 to wheelchair 3, which is locked in position at the foot of bed 2, as shown. Motion of sheet 10 as it is wound up on roller 6 moves the patient 1 over bed 2 onto wheelchair 3, where motion of sheet 13 continues the transfer process. If the velocity and direction of sheet 13 on wheelchair 3 is approximately the same as that of sheet 10 on bed 2, a supine patient on the bed will be transported smoothly onto the surface of the wheelchair 3, or from the wheelchair onto the bed 2.

FIG. 1 shows guidance members 17 which are used to guide sheet 10 onto and off rollers 9 and 8. The hems 16 of the sheet 10 are made thicker than the body of the sheet, and members 17 contain suitably shaped grooves with narrow outer portions 38*a* through which the center section of the sheet 10 slides and with larger inner portions 38*b* through which the thickened hem 16 slides and is restrained and guided. The guidance members 17 are placed as shown in FIG. 1 at the corners of the bed 2 so that the sheet 10 will be guided smoothly and will track properly over rollers 8 and 9 onto rollers 6 and 7. Similarly, hems 18 on sheet 13 on wheelchair 3 are guided by guidance members 19 fastened to the wheelchair 3.

The tub assembly 20 consists of an impervious sheet 21 of material to which is fastened a series of walls 22, shown here as four interconnected, inflatable cylindrical shapes. These walls may be of any shape that will fold up simply when rolled or folded and they can be supported by any suitable means such as internal air pressure or exterior or interior supports, removable or not, as required. Bathtubs of this general type are commercially available for use on beds.

The sheet 21, which may extend beyond the tub walls 22, is fastened to the bed sheet 10 by means of a closure 23 (also shown in FIG. 6) such as zippers, VELCRO, snaps or buttons. The other end of the sheet 21, in FIG. 1, is fastened to a separate auxiliary roller 24, but, as to be shown, it is not a requirement of this invention. This roller 24 is supported by brackets 27*a* and 27*b*, attached to the bed frame 11 and driven by means shown in FIG. 7.

The tub walls 22 and impervious sheet 21 form a water-tight container or bathtub. The technique for loading and unloading the patient from this and similar apparatus is described later and is illustrated in FIGS. 9 through 23.

Figure 5:
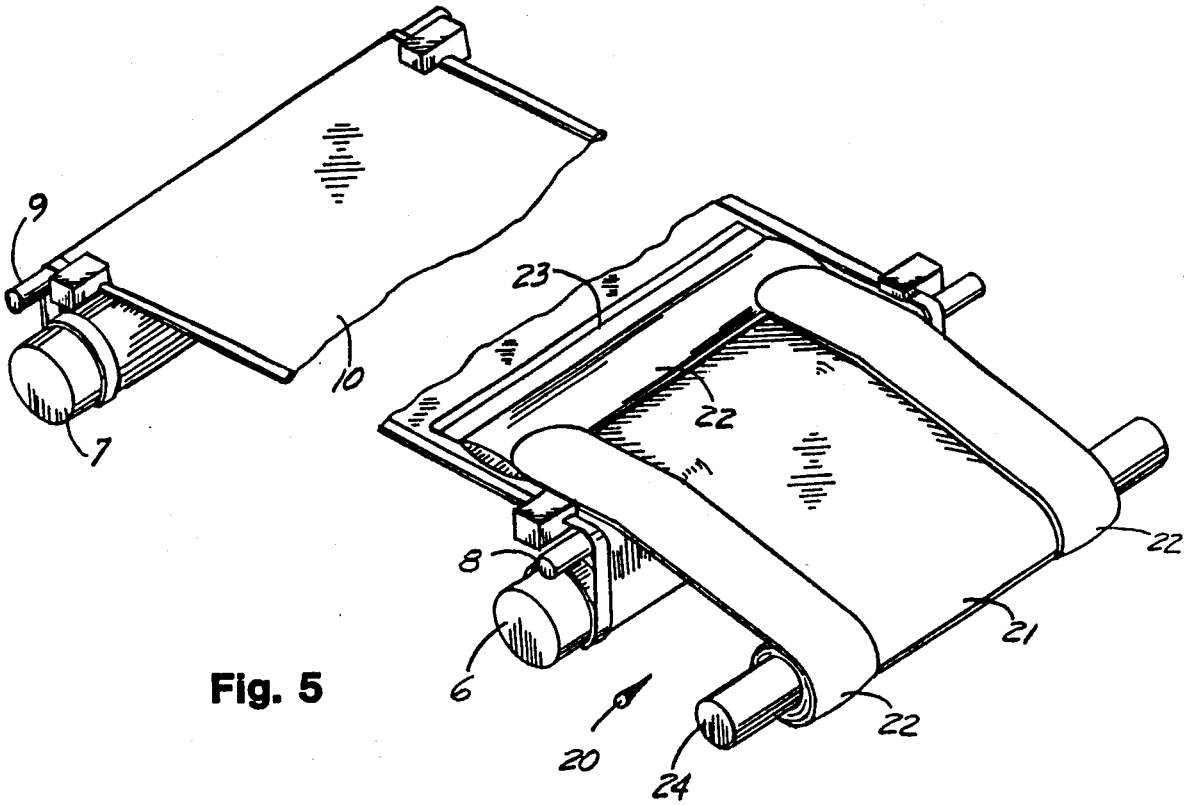
FIG. 5 is a perspective view of the unit as in FIG. 3 when rolled (or unrolled) from storage off bed.

The bathing procedure which is standard and is not shown is as follows: The tub walls 22 are inflated by air pressure from a pump or compressor or otherwise raised to form a tub. This operation may be powered by any conventional means, including manual. To bathe the patient, a hand-held shower connected by a hose to a standard water tap may be used. Alternatively, a cart with water storage, suitable pumps and connections may be used as the supply. To avoid over-filling, a push button valve may be incorporated in the shower head to allow water to flow only as required. The patient may be wet down, soaped, and then rinsed as in a conventional bath. To drain the tub, a hose may be fitted to the lower wall and connected to a floor or other drain, to a pail, or to the afformentioned cart. A wet vacuum may then be used to dry the tub. The walls may be lowered by allowing the air to drain out or by using a vaccuum source. The sheet 10 and collapsed bath tub 20 may then be rolled up on their respective rollers 6 and 24 as shown in FIG. 5.

Figure 2:
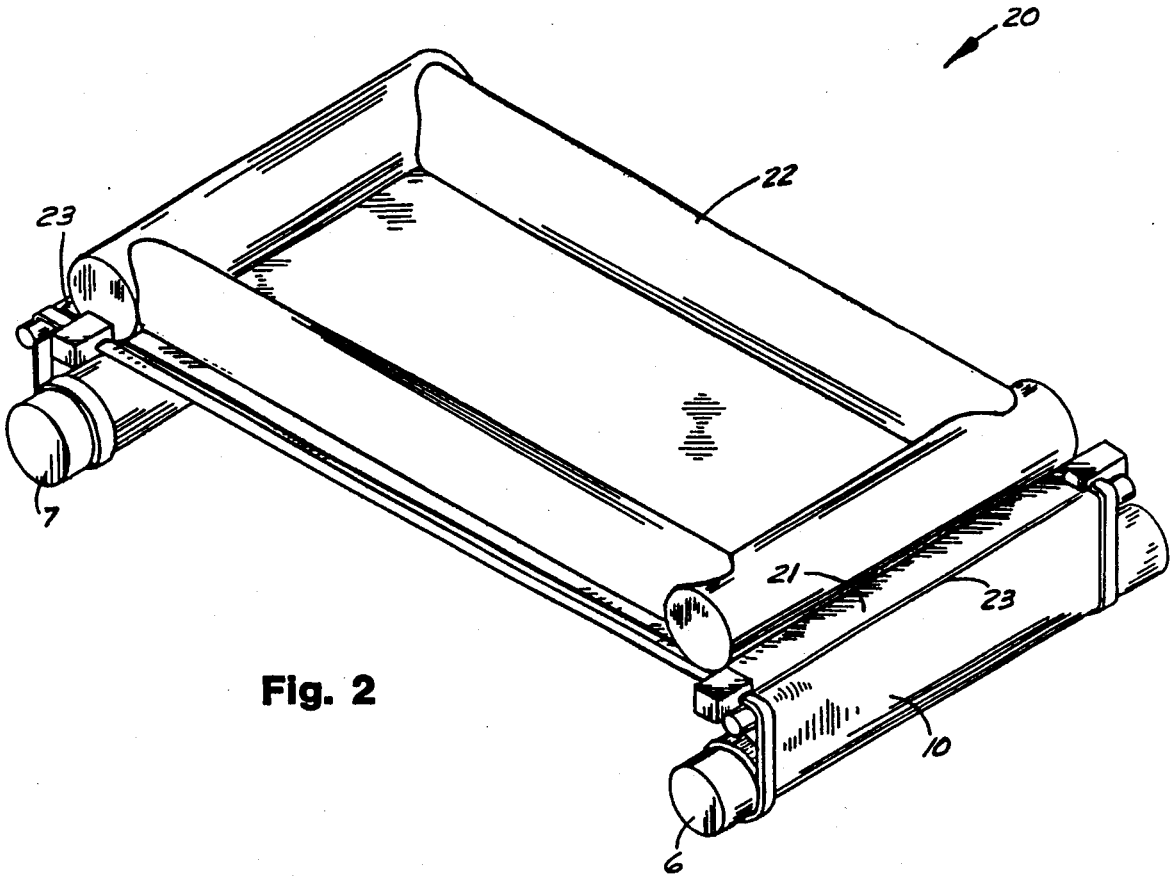
FIG. 2 is a perspective view of one form of "bathtub portion" of this invention, when inflated and ready for use, less patient.
Figure 3:
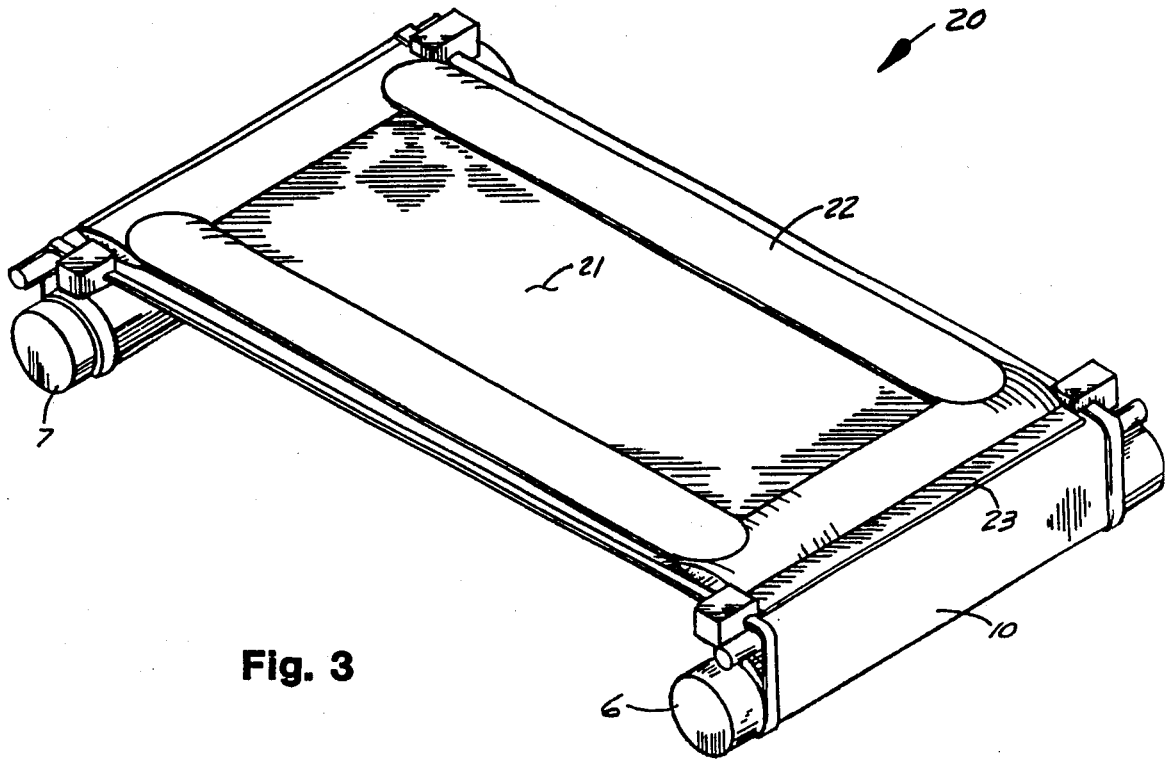
FIG. 3 is a perspective view of one form of the "bathtub portion" of this invention, when deflated.
Figure 4:
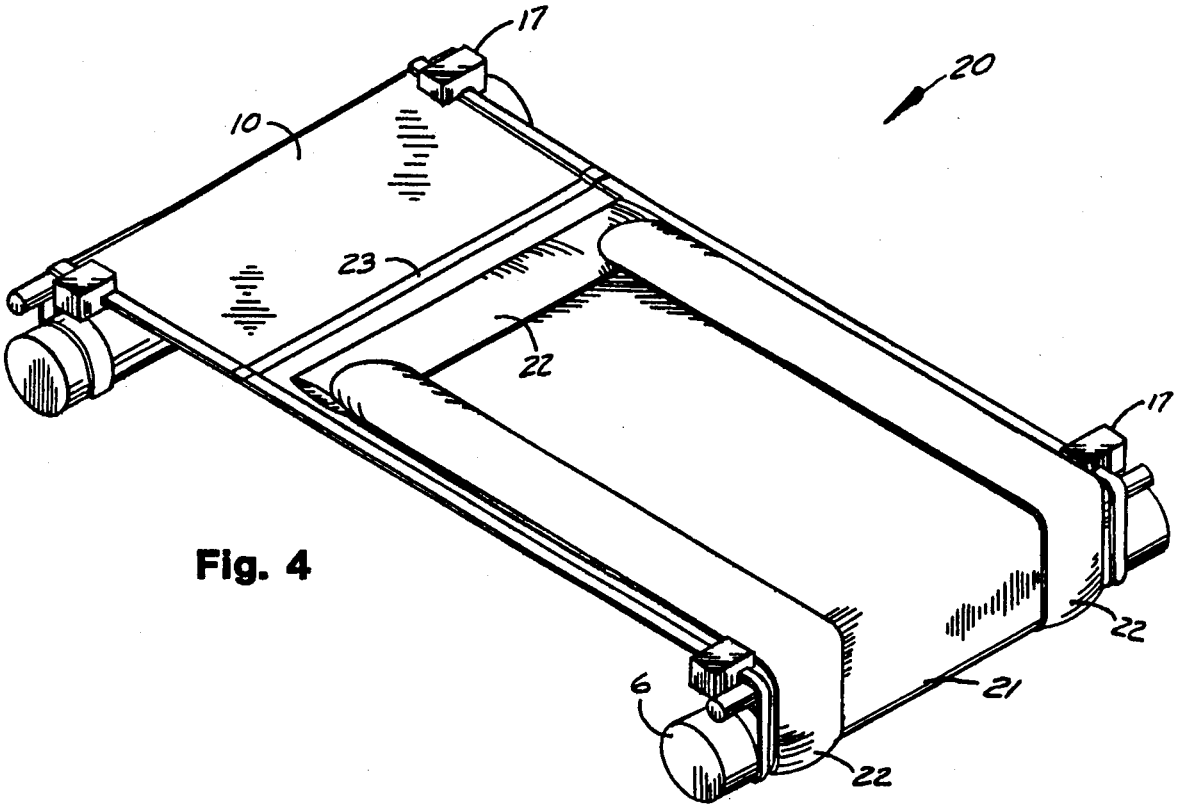
FIG. 4 is a perspective view of the unit as in FIG. 3 when rolled (or unrolled) from storage on bed.

FIGS. 2, 3 and 4 show another version of this invention wherein roller 24 is eliminated and the impervious sheet 21 is fastened at both ends to sheet 10 by closures 23. FIG. 2 shows the tub walls 22 when inflated, FIG. 3 the tub walls 22 when deflated, and FIG. 4 the tub assembly 20 when being rolled up for storage on near end roller 6.

Figure 32A:
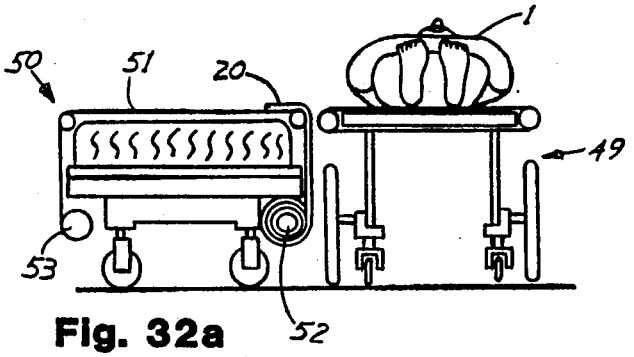
FIG. 32*is a* a schematic view of a configuration similar to FIGS. 2–4 for lateral transfer of a person from a wheelchair to the bed.
FIG. 32*b* is a schematic view using the configuration of FIG. 32*a,* in which the patient is being transferred onto a collapsed tub.
FIG. 32*c* is a schematic view using the configuration of FIG. 32*a,* in which the patient rests in the tub after it has been inflated and partially filled with water.
Figure 32B:
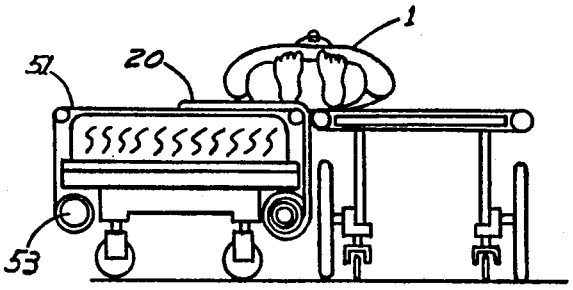
Figure 32C:
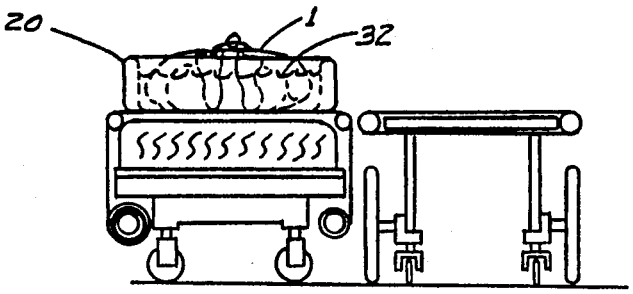

FIG. 32*a* shows schematically a similar configuration of the tub for lateral transfer of a person from a wheelchair 49 to bed 50. The collapsed tub 20 attached to sheet 51 is partially unrolled from roller 52, ready to accept the patient. FIG. 32*b* shows the patient being transferred onto collapsed tub 20 as sheet 51 is being wound up on roller 53. FIG. 32*c* indicates the patient resting in tub 20 after it has been inflated and partially filled with water 32.

Figure 6:
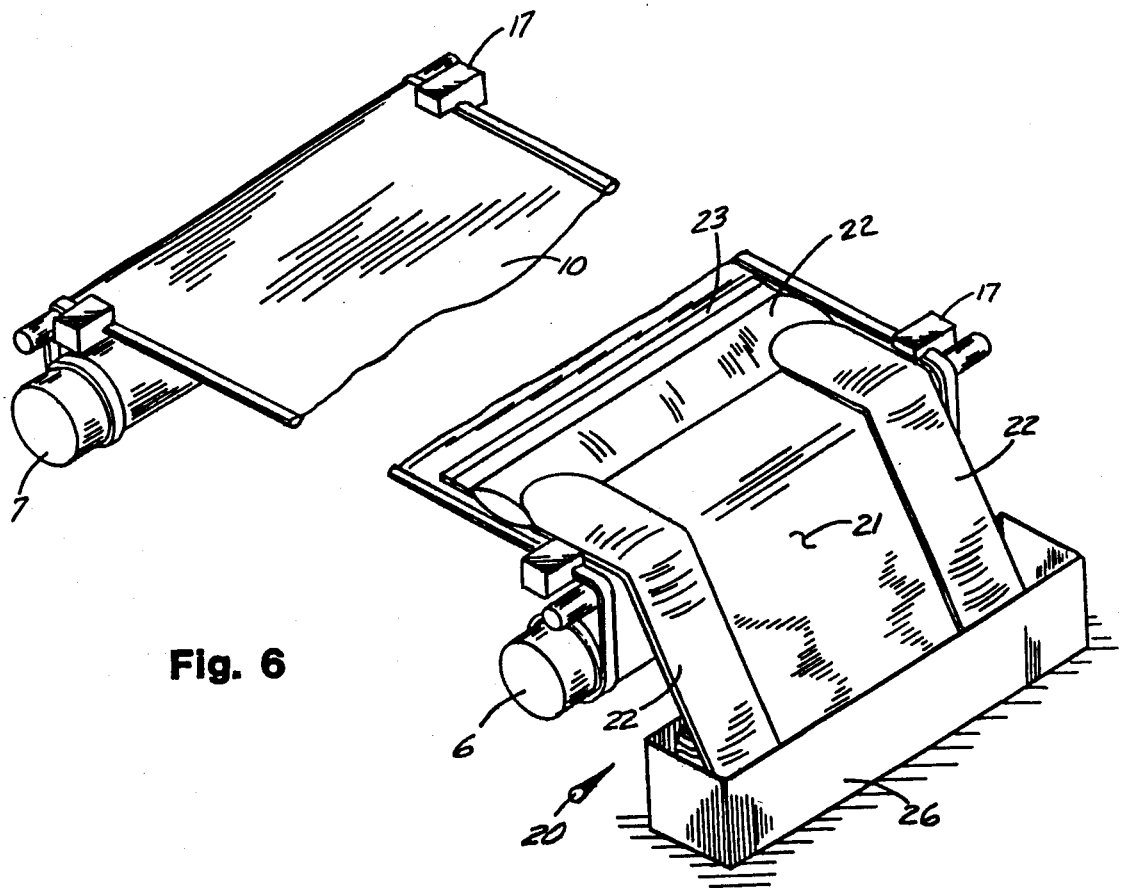
FIG. 6 is a perspective view of the unit as in FIG. 3 when deployed from (or to) storage (not rolled)

FIG. 6 depicts a separation of sheets 10 and 21 during storage with the tub assembly 20 going into a box 26 or other passive storage device.

In the embodiments shown in FIG. 1, 5 and 6, the tub assembly 20 may be unfastened by opening closure 23 and then the sheet 10 may be used as desired. In the embodiment in FIGS. 2, 3 and 4, the tub assembly 20 may remain attached to sheet 10. Its location must be taken into account when using the sheet as a transport device in transferring a patient onto the bed 2.

Figure 7:
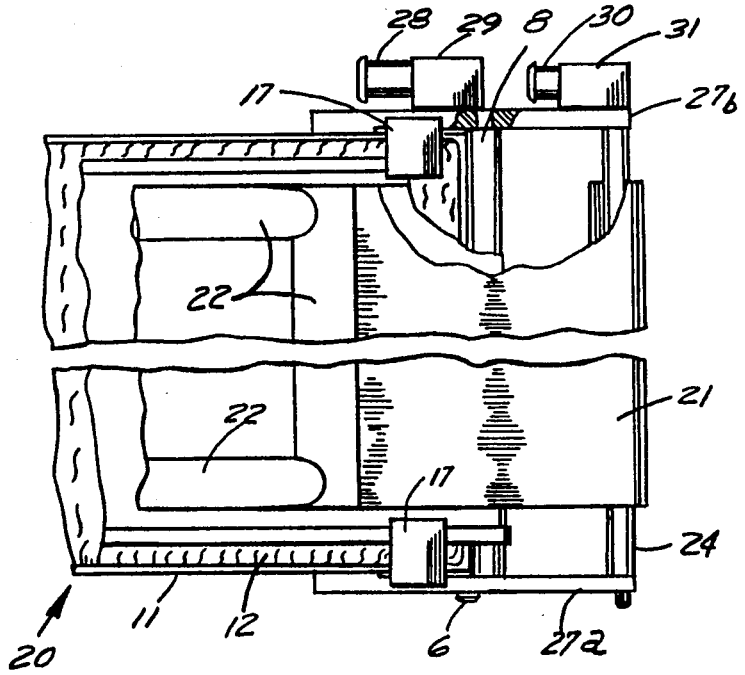
FIG. 7 is a partial plan view of the bed as shown in FIG. 1.
Figure 8:
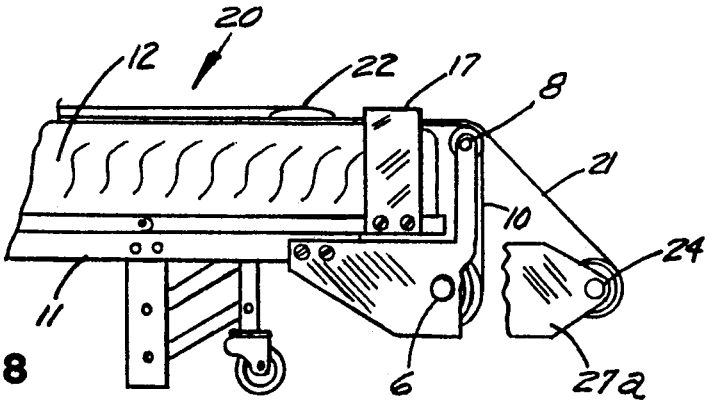
FIG. 8 is an elevation view of an item in FIG. 7.

FIG. 7 is a plan view and FIG. 8 an elevation view showing the drives of the various storage rolls for the sheets 10 and 21 (which is part of tub 20) used in the embodiment of FIG. 1. Idler roller 8, foot roller 6 and auxiliary roller 24 are supported in brackets 27*a* and 27*b* mounted to bed frame 11. Foot roller 6 is driven by motor 28 driving through gear box/clutch 29. Roller 24 is driven by motor 30 driving gear box/clutch 31.

When the tub assembly 20 is being deployed to the left in FIGS. 7 and 8, a motor 56 through gear box-/clutch 57, drives roller 7 in FIG. 1 and pulls sheet 10 to the left. The closure 23 (shown in FIG. 5) between sheets 10 and 21 pulls the tub assembly 20 to the left. During this process, the gear box/clutch 29 is disengaged and sheet 10 unrolls freely from roller 6. The gear box/clutch 31 also is disengaged to allow the tub assembly 20 to unroll from roller 24.

When the tub assembly 20 is being removed or moved to the right, the gear box/clutch on roller 7 is disengaged and motor 28 driving gear box/clutch 29 rolls up sheet 10 on roller 6 and motor 30 drives gear box/clutch 31 to roll up sheet 21 with folded bathtub walls 22 on roller 24.

Figure 7B:
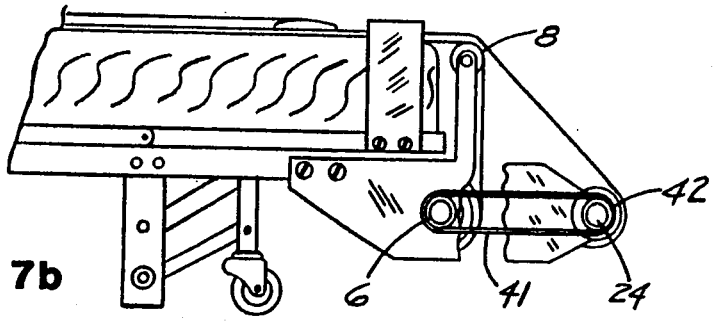
FIG. 7*b* is a partial side elevation view showing a belt drive for the auxiliary roller.
Figure 7A:
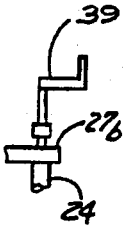
FIG. 7*a* is a view of a hand crank for an auxiliary roller.
Figure 7C:
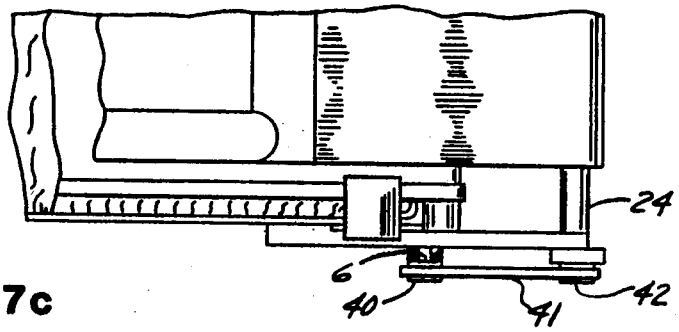
FIG. 7*c* is a partial plan view showing the belt drive of FIG. 7*b;*
Figure 7D:
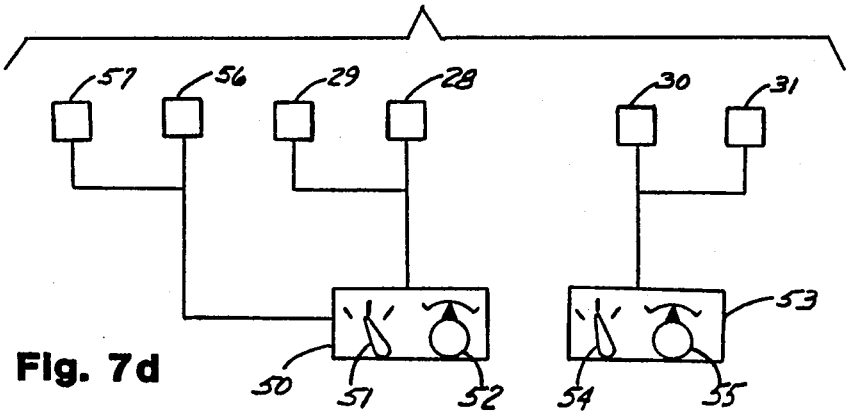
FIG. 7*d* is a schematic diagram of the electrical controls for the roller drivers in FIG. 1.

FIG. 7*d* is a schematic diagram of the control system whereby an operator can control the relative speed to prevent excessive slack from developing in either sheet 10 or sheet 21 as the sheets are taken up on rollers 6 and 24. Such variable speed motor control systems are well known to those skilled in the art and are widely used. Control box 50, which controls the motion of sheet 10, includes a spring-return, momemtary contact forward-reverse switch 51 and a variable speed control 52. Electrical cables connect to motor 56 and clutch 57 and to motor 28 and clutch 29. The motor speed control and switching circuitry is packaged in control box 50. Control box 55 is similar to control box 50, except that it connects to motor 30 and clutch 31. Momentary contact switch 54 has no reverse position. Control 55 provides variable speed control for motor 30. Alternatively, control 55 can be designed to provide variable torque control, or control 55 can be omitted and the operator can use switch 54 intermittently for torque conrol on motor 30 to take up slack in sheet 21 as required. A further alternative is to measure the tension in sheet 21 by a sensing device and used to control motor 30 automatically to take up the slack.

In another procedure, not illustrated, sheet 21 is unfastened from sheet 10 and is rolled up independently from sheet 10, by motor 30, or by means of a hand crank 39 in place of motor 30 as shown in FIG. 7*a*. Thereafter, sheet 10 is moved between rollers 6 and 7 as desired.

FIG. 7*b* and 7*c* show a further embodiment which replaces motor 30 and gear box 31 with a belt drive arrangement whereby pulley 40 on roller 6, as shown (or alternatively, on roller 8), drives pulley 42 by means of belt 41. Pulley 42 in turn drives one-way drag clutch 43, which applies a drag torque to cause roller 43 to wind up sheet 21 when sheet 10 is being wound up on roller 6. The speed ratio of the drive is chosen to prevent slack from developing on sheet 21. When sheet 10 is being unwound from roller 6, pulley 42 is rotating in the opposite direction with respect to roller 24, and in this direction the one-way clutch 43 turns freely without applying torque to roller 24 which is free to unroll sheet 21 as required. Alternatively, clutch 43 may be an electrically engageable clutch instead of a one-way clutch. In this case, clutch 43 will be engaged electrically when the tub 20 is to be rolled up on roller 24.

If closure 23*a* is implemented with VELCRO, it can be designed to automatically peel off and disconnect as sheets 21 and 10 are wound up on their respective rollers 24 and 6. With most other fasteners, the sheet motion must be stopped to open closure 23 manually.

Figure 13:
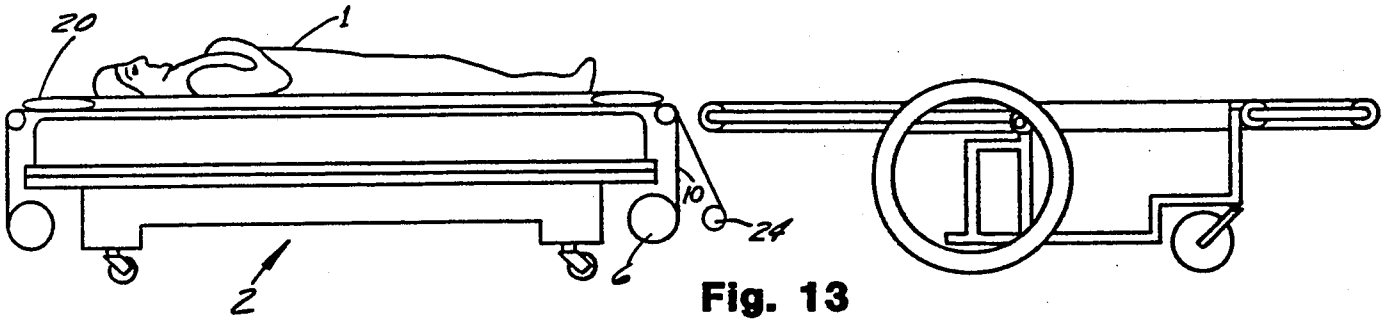
Figure 14:
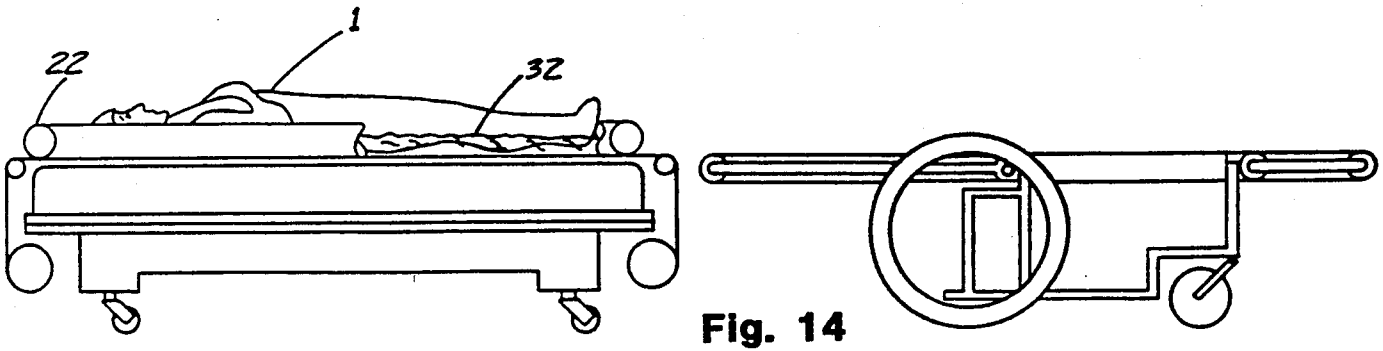

FIGS. 9 through 13 show schematically a possible sequence of operations to use the equipment arrangement shown on FIG. 1. In FIG. 9, the person 1 is shown supine on bed 2 with wheelchair 3 fixed in position end-to-end at the foot of the bed 2 and both are at the same elevation. If roll 6 rotates clockwise, sheet 10 will wind up on roll 6 and move across the surface of the mattress 12 to the right, carrying the supine person 1 with it. If belt 13 on wheelchair 3 is also actuated to move in the same direction and velocity as sheet 10, then the person 1 will be transferred smoothly from bed 2 to wheelchair 3 as in FIGS. 2 and 3. When the person is on the wheelchair 3, or other suitably equipped transfer device, the tub assembly 20 is fastened to sheet 10 by the closure 23. If roll 7 is now rotated counter-clockwise as in FIG. 12, then sheet 10 will move to the left, unrolling from roll 6, pulling the tub assembly 20 and unrolling it from roll 24. At the proper time, sheet 13 on wheelchair 3 is moved to the left to transport the supine person 1 to the left and place the person into the proper bathing area in the tub assembly 20 as it is being pulled onto bed 2. The result is shown in FIG. 13 with the person 1 located on the bed 2 in the tub assembly 20. If the tub rolls 22 are erected as in FIG. 14, the person may now be bathed. After use, the tub assembly 20 must be drained, the walls 22 lowered, and the operations reversed from FIG. 14 through 9 with all directions reversed, closure 23 being disengaged and rollers 6 and 24 rolling up their respective sheets 10 and 21 in FIG. 12.

This sequence is also relevant to the apparatus shown in FIG. 6 except that in this case, the tub is initially drawn out of storage box 26 and returned to it after use, instead of being stored on roller 24.

If the apparatus is arranged as in FIGS. 2, 3 and 4 with the tub assembly 20 fastened on both ends to, or part of, sheet 10, there are two possible sequences. If the tub assembly is stored on roller 7, at the head end of the bed 2, then after the patient has been transferred to wheelchair 3, the sheet 10 must continue to move to the right until the tub assembly 20 is wrapped around roller 6 with its leading edge at closure 23 ready to receive a supine person. The sequence can then continue as in FIGS. 12, and 13 except that the tub assembly 20 will be drawn off roller 6 alonq with sheet 10 and roller 24 will not exist. After bathing, when the tub 20 is returning to storage on roller 7, the patient must be held on wheelchair 3, as in FIG. 11, while the tub 20 rewinds to the left toward its proper place on roller 7. In the other sequence, where the tub 20 is stored on roller 6 at the foot of bed 2, then the patient 1, after being transported to wheelchair 3, must be held there while the sheet 21 is moved to the left until the tub 20 is in a position to be transferred onto bed 2 so as to receive the supine person. The sequence will then continue as above, except that for storage, the sheet 10 will move to the right to restore the tub 20 on roll 6, and at least one bed sheet length will also be stored around the tub assembly before the patient is returned to the bed 2 onto sheet 10.

Figure 15:
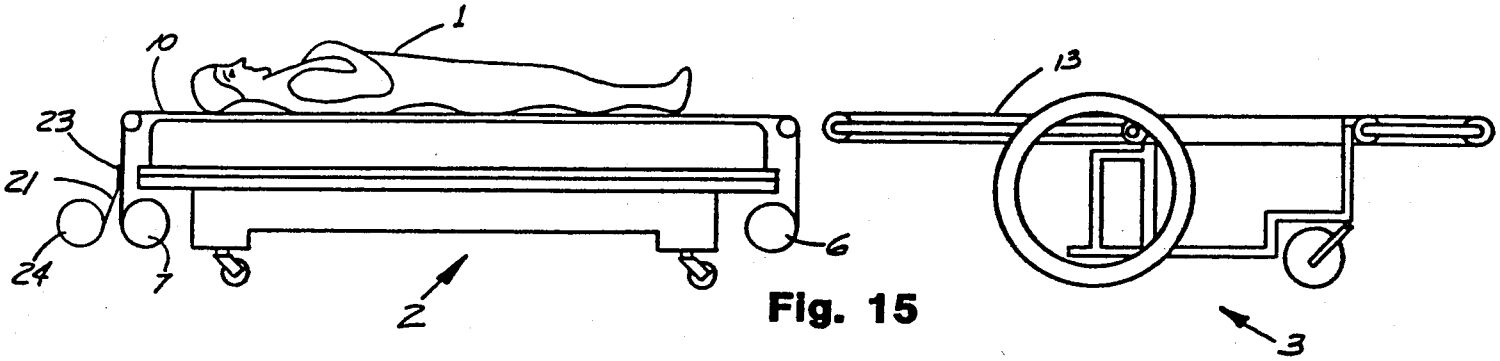
FIGS. 15 through 20 are schematic sequenced views showing the operation of this invention using the bathtub apparatus stored at head end of bed.
Figure 16:
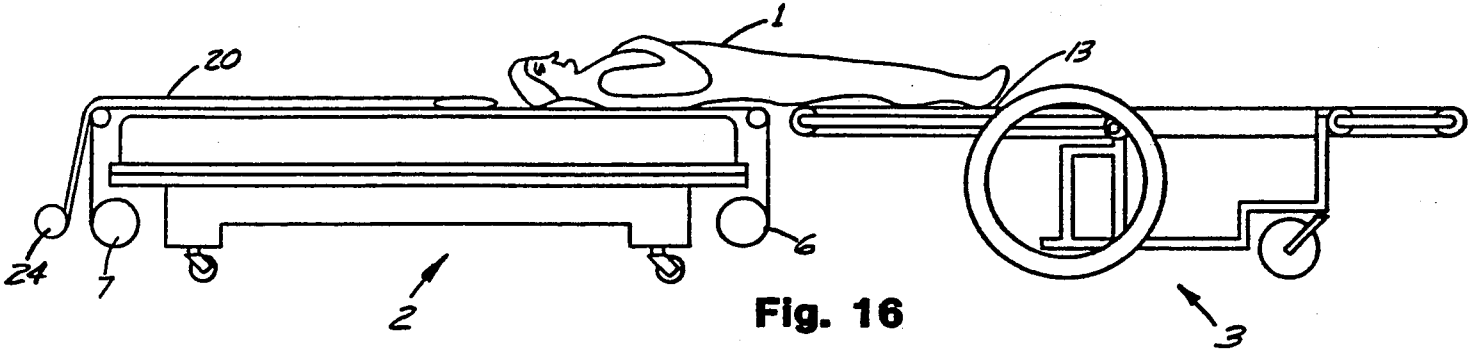
Figure 17:
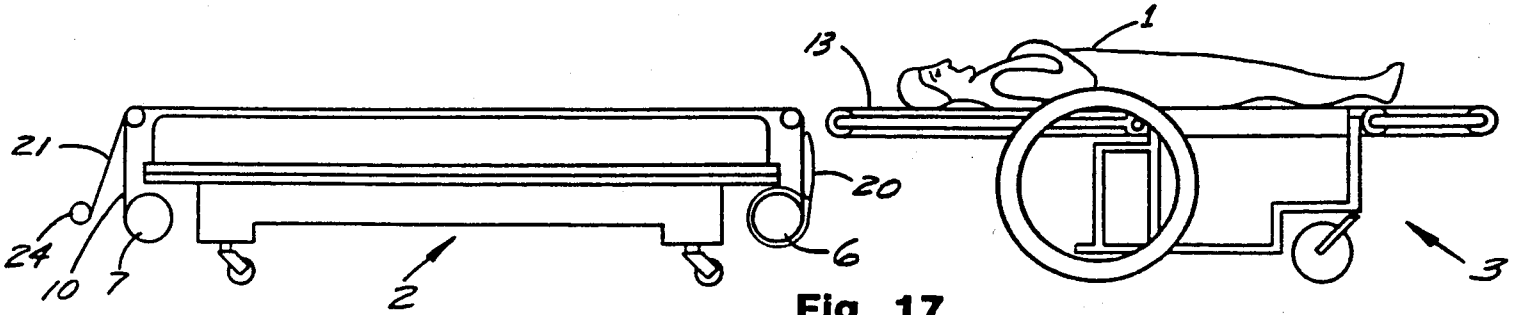
Figure 18:
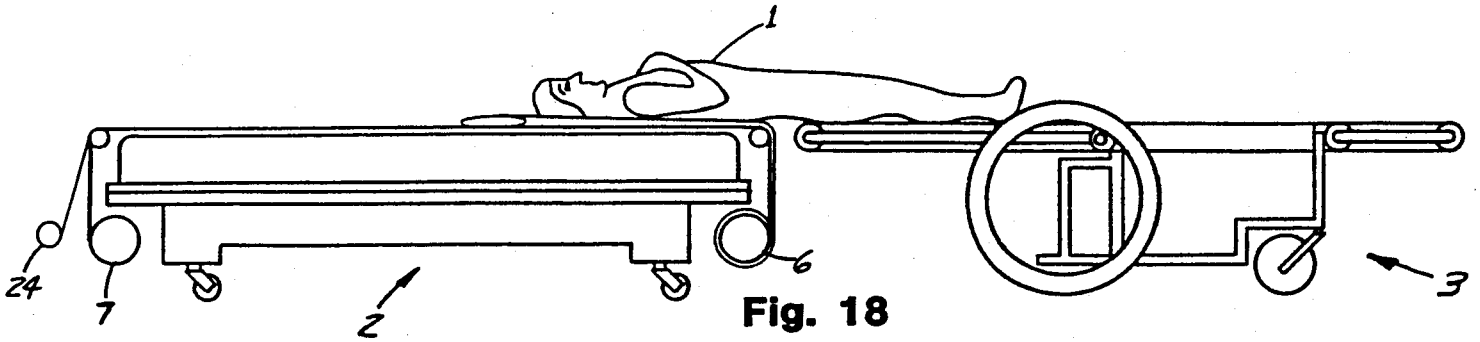
Figure 19:
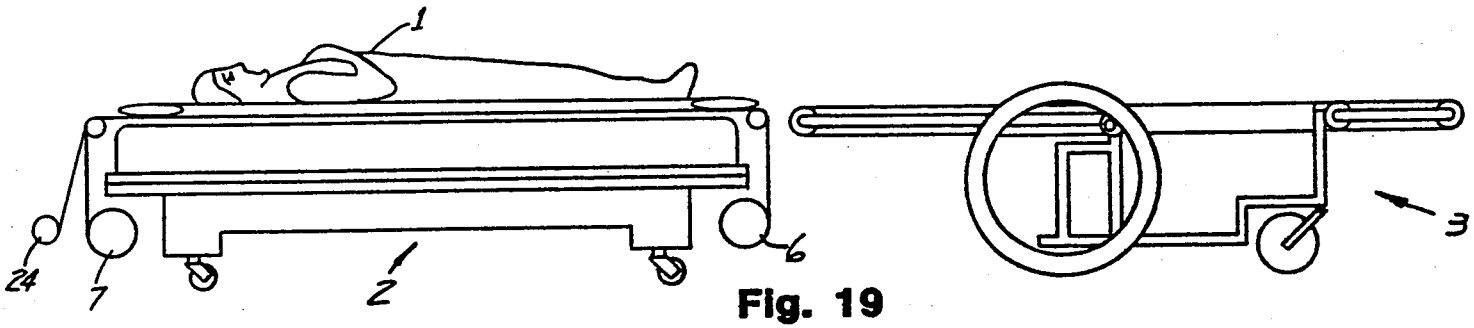
Figure 20:
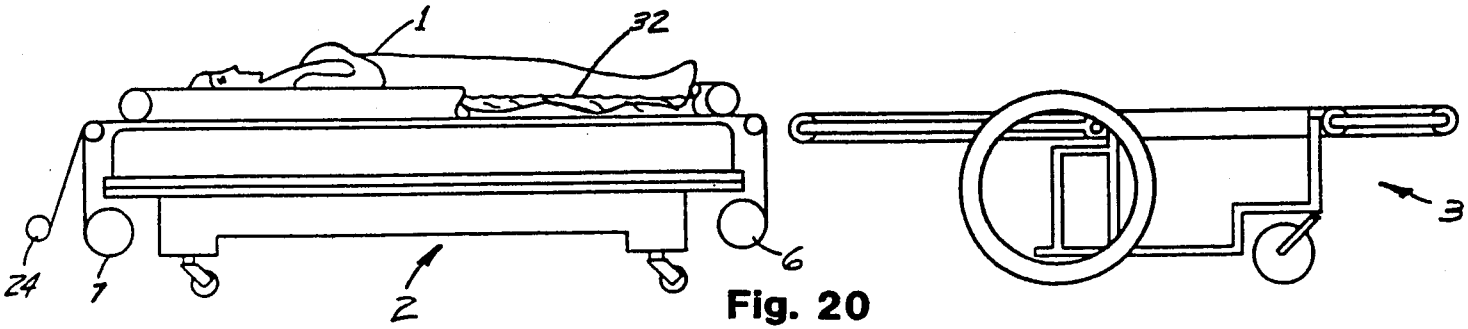

The same equipment shown in FIG. 1 may be rearranged to that shown in the sequence of FIGS. 15 through 20. In this case, the auxiliary roller 24 with the tub assembly 20 is positioned at the head end of bed 2 near roll 7 and, as shown in FIG. 15, the closure 23 between sheets 10 and 21 must first be secured. Then, as in FIG. 16, the person 1 is transferred to the wheelchair 3 or other suitably equipped surface. In FIG. 17, as the person is held on wheelchair 3, the sheet 10 and tub assembly 20, including sheet 21, are rolled about roller 6. FIGS. 18, 19 and 20 are the same as FIGS. 12, 13 and 14 except that the tub assembly is drawn off roller 6 instead of roller 24, and the speed of auxiliary roller 24 is controlled, as described earlier, so that the velocity of the sheet 21 and bathtub 20 matches that of sheet 10. To return the patient from the bathtub 20 to bed 2, the sequence from FIGS. 20 through 15 is reversed, except that in FIG. 17, the tub assembly is unrolled from roller 6, and, in FIGS. 16 and 17, the velocity of the tub assembly must match that of sheet 10.

For a configuration in which the tub assembly 20 is loose, as in FIG. 6, and is located at the head of the bed 2, then a second closure similar to closure 23 will be required at each end, so that each end of bathtub sheet 21 can be fastened to sheet 10. Some manual handling may be required to return the tub assembly 20 to storage 26.

Figure 21:
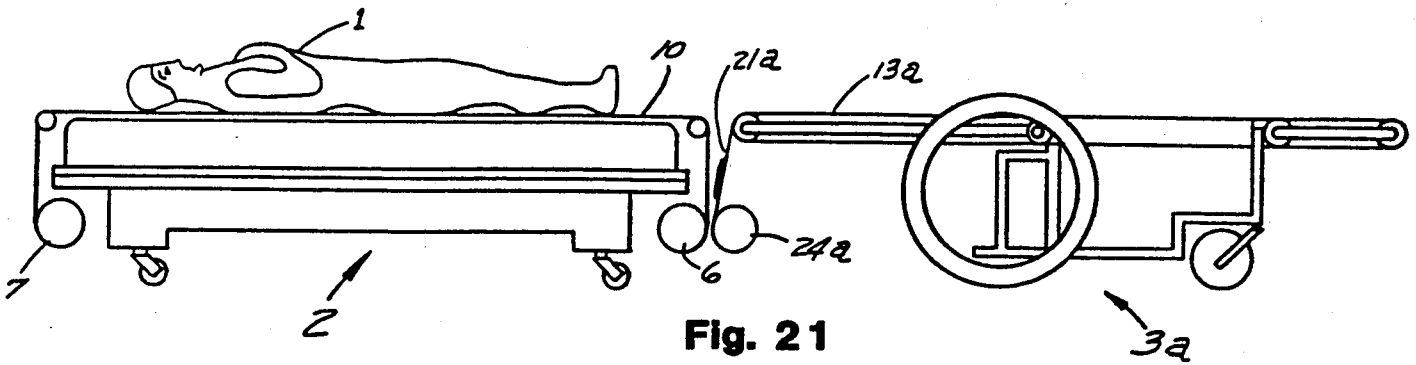
FIGS. 21 through 23 are schematic sequenced views showing operations of this invention using the bathtub stored on the auxiliary surface.
Figure 22:
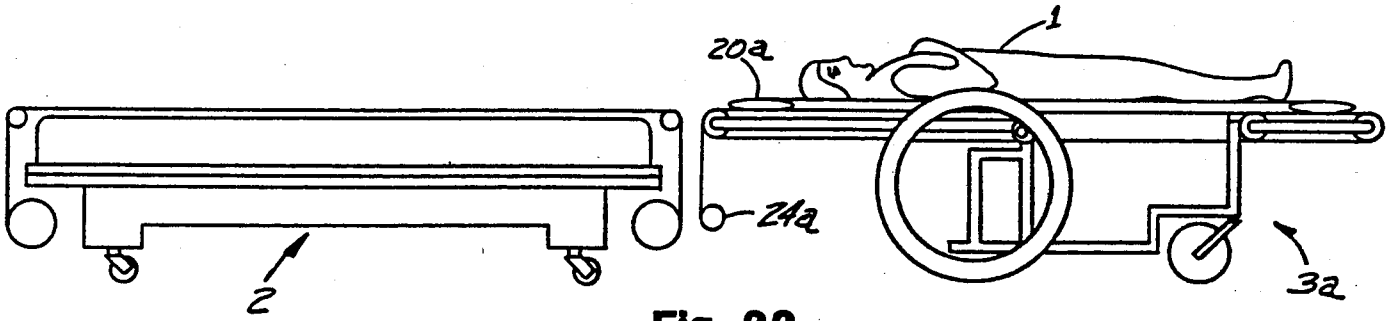

In another embodiment of the present invention, the surface of wheelchair 3*a*, shown in FIG. 21, is used as the bathing area. This may require additional support structure on wheelchair 3*a* for strength and stability. The tub 20*a*, for the wheelchair 3*a*, may have to be smaller than tub 20 for bed 2 because of the limited space on wheelchair 3*a*. As seen in FIG. 21, roller 24*a* is fastened to the lower part of wheelchair 3*a*. Impervious sheet 21*a* of tub assembly 20*a* is fastened by closure 23*a* to endless belt 13*a*. Roller 6 is driven clockwise to transport the supine person to the right and beyond the edge of the bed 2. The top surface of sheet 13*a* will, at the proper moment, also be driven to the right, unwinding tub assembly 20*a* from roll 24*a*. The patient will then arrive at the edge of the bed 2 at the right moment to be transported on top of the tub assembly 20*a* and be transferred to the position shown in FIG. 22. If the walls 22*a* of the tub assembly 20*a* are raised, as in FIG. 23, the patient may be bathed. After bathing, the bath water 32 must be drained, the tub walls 22*a* must be lowered and the top surface of sheet 13*a* driven to the left to return the patient to bed 2. The surface velocities of wheelchair sheet 13*a* and bed sheet 10 must be approximately matched by use of a manually controlled variable speed drive or by automatic control means on one of the roller drives.

In another configuration, the tub assembly 20*a* may be loose on the floor or in a box at the head end of wheelchair 3*a*. One end of the tub sheet 21 is fastened by closure 23*a* to wheelchair belt 13*a*. The operation is as described above, except that the bath tub is drawn up from the floor rather than unwound from roller 24*a*. In another implementation, the tub assembly 20*a* would be attached to the part of sheet 13*a* under the wheelchair or other suitable apparatus and would automatically be transported to the top of the wheelchair 3*a* by sheet 13*a*.

There are many devices that are available to reduce or periodically vary the pressure against a supine patient's body to prevent decubitus ulcers (bedsores) from forming. Some such devices employ air pressure to alternately raise and lower the pressure in two sets of interleaved inflated tubes on a special air mattress.

FIG. 24 shows a partial perspective view of the sheet 10 between rollers 6 and 7 as before and supported by corner guidance members 17 supporting the bed sheet hem 16. Attached to this sheet 10 by closures 36*a* and 36*b* in the form of VELCRO, zippers for example, is a bedsore prevention pad 35. This consists of manifold 33*a* with its air passage connected to one set of tubes 34*a* and manifold 33*b* connected to the other set of tubes 34*b*. Each manifold 33*a* and 33*b* is supplied by tubes and fittings with a supply of compressed air, and each can be supplied independently or vented. The controls, fittings, etc. are well known in the art and are therefore not described further herein. FIG. 25 is a section through pad 35 of FIG. 34, showing all of the tubes inflated. Similarly, FIG. 26 shows tubes 34*a* deflated and FIG. 27 shows tubes 34*b* deflated. This alternating inflation and deflation will shift the support on the supine person by lowering the pressure on various parts of the body at different times and help prevent decubitus ulcers from forming. FIG. 28 shows an optional cover sheet 45 on which a person may lie and which can be placed over pad 35 and removably attached to it by fasteners 45 in the form of VELCRO, zippers, or snaps, for example.

Figure 29:
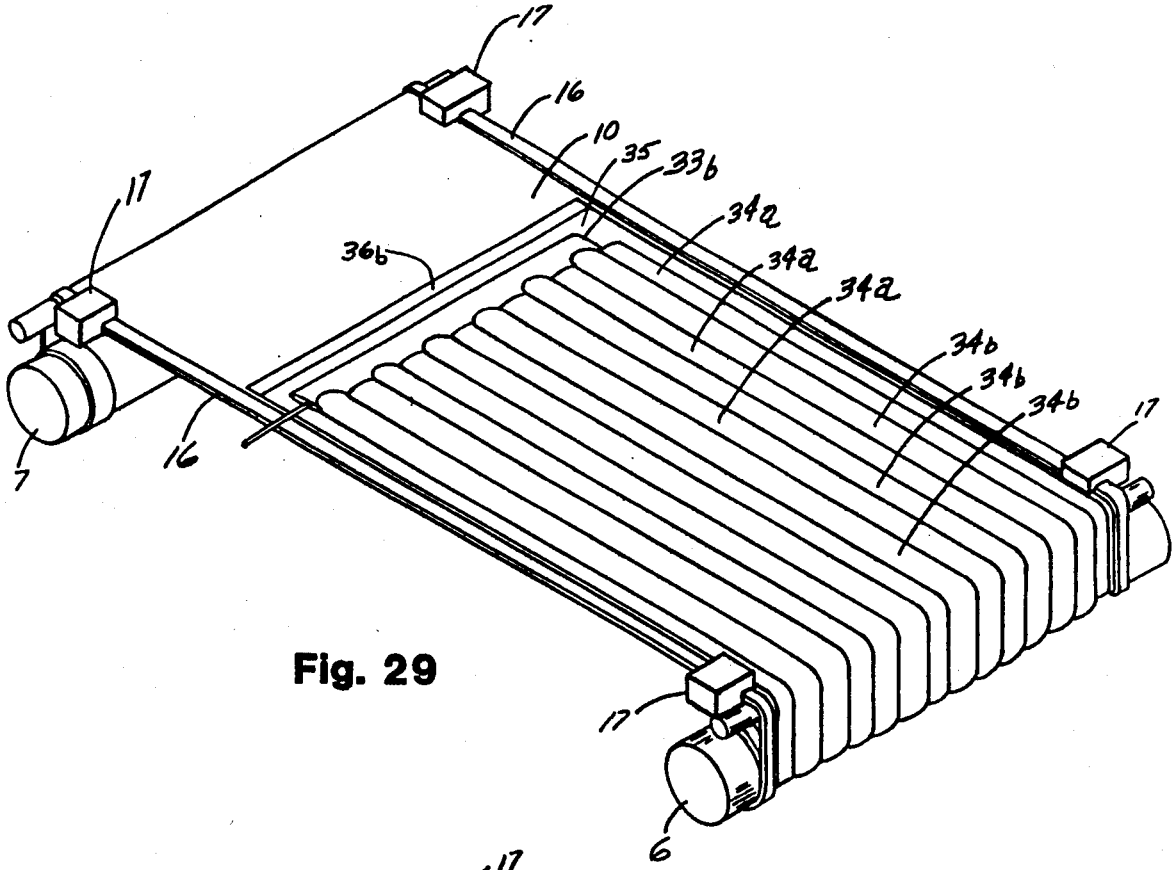
FIG. 29 is a perspective view of one form of the bedsore preventor portion of this invention when rolled on main bed sheet roll.
Figure 30:
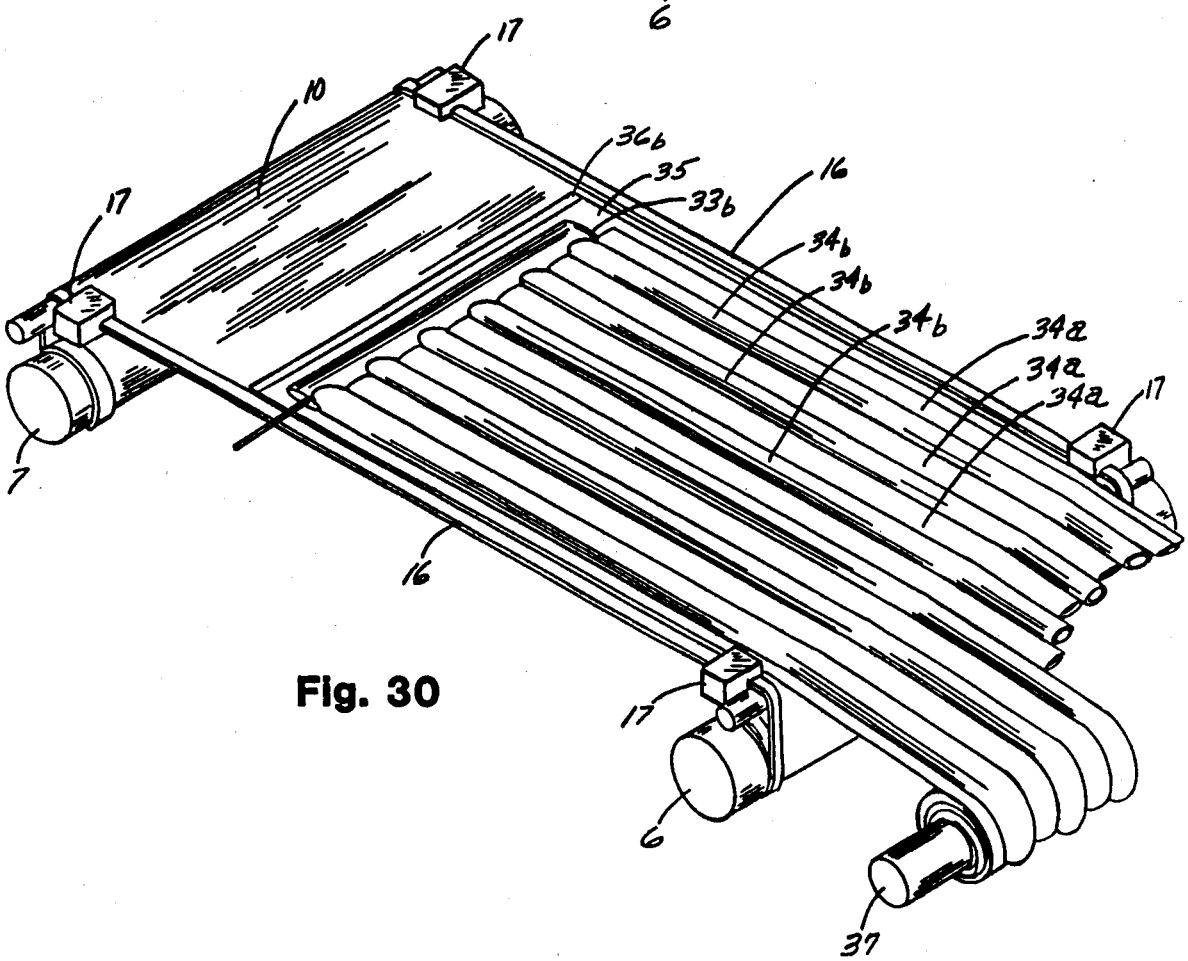
FIG. 30 is a perspective view of one form of the bedsore preventor portion of this invention when rolled on auxiliary roller.

FIGS. 29 and 30 show two of the ways this pad 35 may be stored and deployed, as required. In FIG. 29, the pad 35 is fastened to sheet 10 on both ends and when not in use, is rolled with sheet 10 about roller 6. In FIG. 30, pad 35 is fastened to sheet 10 at one end only by closure 36*b*, and stored on auxiliary roller 37.

As seen from comparing FIGS. 4 and 29 and FIGS. 5 and 30, the bedsore protection pad 35 can be stored and deployed in the same manner as the bathtub 20.

Any other bedsore prevention device or other device such as a pad, or a stretcher cloth with the rigid members of the stretcher removed, or other sheet of material, that may be folded, rolled or otherwise fed onto a bed or other surface by a moving sheet, may be utilized in the same manner.

For example, sheet 21, as shown in FIGS. 4 and 5, may be used, without walls 22, as an impermeable sheet removably attached to the movable sheet 10 on a bed. It may also be a multi-layer sheet, or a bed sheet, or a pad, or a stretcher cloth, for example. Similarly, pad 35 in FIGS. 29 and 30, removably attached to sheet 10, may be a heating pad 35*a* or other accessory instead of a bedsore protection pad.

The bathing tubs and the other devices may be stored on the same or different rollers affixed to the bed 2. They may be on auxiliary rollers or stored separately and used as needed by a patient. They can also be stored on the same roller attached to different portions of a bathtub 20 or on sheet 21 and deployed as needed.

Figure 31:
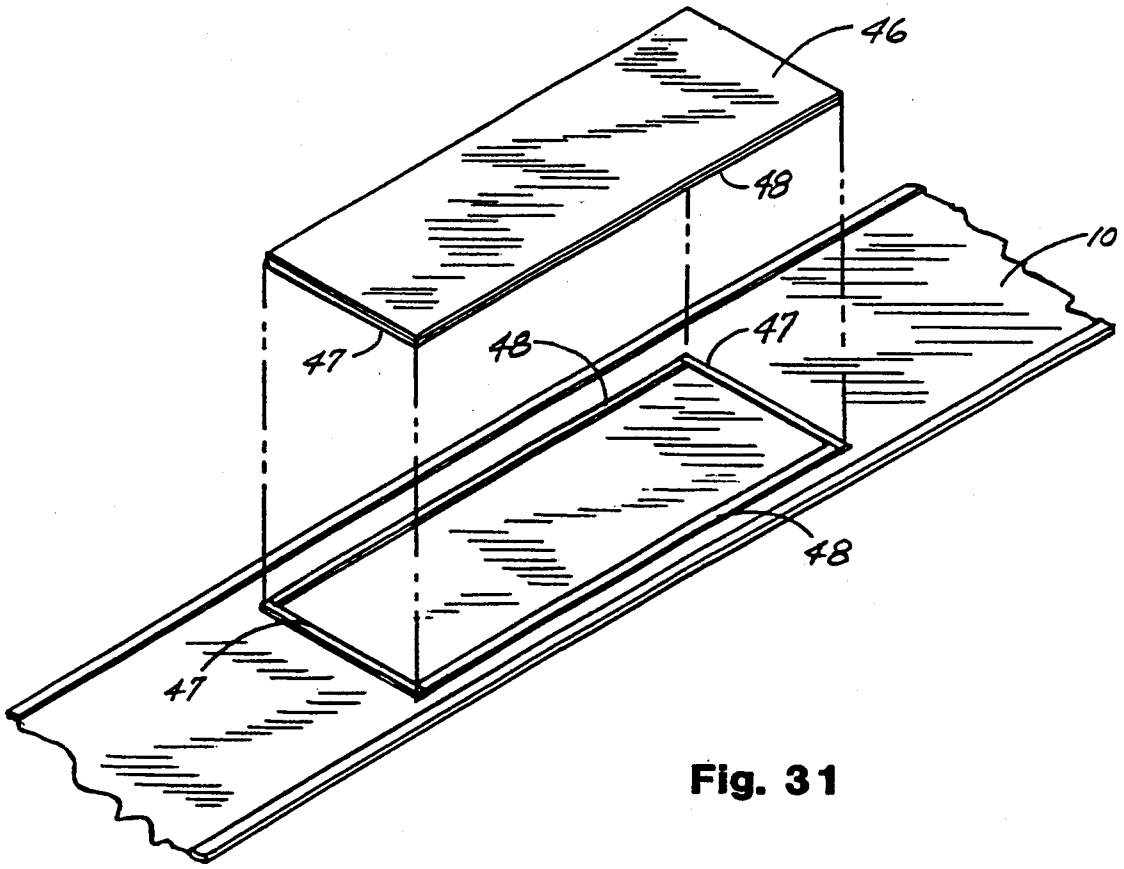
FIG. 31 is a perspective view showing an arrangement for attaching an additional sheet to the movable transfer sheet on a bed.

A further object of this invention is to provide an arrangement for easily changing a soiled bed sheet. FIG. 31 shows a perspective view of an arrangement for removably attaching a sheet of material 46 to movable sheet 10 on a bed. Attachment means, such as VELCRO, may be arranged as lateral strips 47, longitudinal strips 48 or may be located in other suitably placed locations. Alternatively, other type fasteners such as snaps, zippers, hooks and eyes or buttons can be used.

Sheets 10 and 46 can be of any flexible material or combinations of material. A particularly useful combination is for sheet 10 to be strong, for transfer use, and impermeable, and for sheet 46 to be a soft and comfortable bed sheet for a person to lie on. Such a sheet can be readily changed after transferring the patient to a reclined wheelchair.

Additional pads or other similar accessories can be added on top of or below the sheet 46, using attachments such as 47 or 48 on sheet 10 or attachments on sheet 46, similar to attachments 45 on pad 35 in FIG. 28.

FIG. 32*a* shows schematically a similar configuration of the tub for lateral transfer of a person from a wheelchair 49 to bed 50. The collapsed tub 20 attached to sheet 51 is partially unrolled from roller 52 ready to accept the person 1. FIG. 32*b* shows the person 1 being transferred onto collapsed tub 20 as sheet 51 is being wound up on roller 53. FIG. 32*c* indicates the patient resting in tub 20 after it has been inflated and partially filled with water.

We claim:

1. A bed having a first sheet of material extending thereacross and roller means at opposite edges of the bed; a power source to rotate said roller means for pulling said first sheet across the bed by said roller means; a second sheet of material having four secured corners; said first sheet and said second sheet being rollable and unrollable from said roller means; attachment means on said first sheet for removably fastening said second sheet of material with said four corners secured so that said first and second sheets maintain a predetermined order and relative positions after being rolled and unrolled from said roller means.

2. A person transfer arrangement as defined in claim 1, wherein said attachment means comprises snap fasteners.

3. A person transfer arrangement as defined in claim 1, wherein said additional sheet comprises an impermeable sheet member.

4. A person transfer arrangement as defined in claim 1, wherein said first sheet is impermeable and said additional sheet is permeable.

5. A person transfer arrangement as defined in claim 1, wherein said attachment means comprises a fastener forming a closure between surfaces held together after being brought into contact, said fastener becoming opened after said surfaces are pulled apart.

6. A person transfer arrangement as defined in claim 1, wherein said attachment means comprises a fastener forming a closure between surfaces held together after being brought into contact, said fastener becoming opened after said surfaces are pulled apart.

7. A person transfer arrangement as defined in claim 1, including additional fasteners for attaching said second sheet to a third sheet.

8. A person transfer arrangement as defined in claim 1, including fasteners on said first sheet for attaching said first sheet to a third sheet and overlapping said second sheet.

9. A person transfer arrangement comprising a bed having a first sheet of material extending across the bed with first roller means at opposite edges of the bed; a power source to rotate said roller means for pulling said sheet across the mattress by said roller means; a support adjacent to said bed having a second sheet of material extending across it and on which a person may lie; a second roller means to move said second sheet of material across said support; means for controlling motion of sheets on said bed and said support to transfer a supine person in either direction between said support and said bed; attachment means on said first sheet for removably fastening a flexible apparatus to said first sheet and drawing up said flexible apparatus on said bed by the moving sheet; means for controlling motion of sheets on the bed and support so that a person may be transported in either direction between said support and said flexible apparatus on said bed; said flexible apparatus comprising a collapsed inflatable bathtub inflatable on said bed and fillable with water for bathing a person.

10. A person transfer arrangement comprising a bed having a first sheet of material extending across the bed with first roller means at opposite edges of the bed; a power source to rotate said roller means for pulling said sheet across the mattress by said roller means; a support adjacent to said bed having a second sheet of material extending across it and on which a person may lie; a second roller means to move said second sheet of material across said support; means for controlling motion of sheets on said bed and said support to transfer a supine person in either direction between said support and said bed; attachment means on said first sheet for removably fastening a flexible apparatus to said first sheet and drawing up said flexible apparatus on said bed by the moving sheet; means for controlling motion of sheets on the bed and support so that a person may be transported in either direction between said support and said flexible apparatus on said bed; said flexible apparatus comprising a collapsed bathtub erectable on the bed by support members.

11. A person transfer arrangement comprising a bed having a first sheet of material extending across the bed with first roller means at opposite edges of the bed; a power source to rotate said roller means for pulling said sheet across the mattress by said roller means; a support adjacent to said bed having a second sheet of material across it and on which a person may lie; second roller means to move said second sheet of material across said support; means for controlling motion of sheets on said bed and said support to transfer a supine person in either direction between said support and said bed; attachment means on said first sheet for removably fastening a flexible apparatus to said first sheet and drawing up said flexible apparatus on said bed by the moving sheet; means for controlling motion of sheets on the bed and support so that a person may be transported in either direction between said support and said flexible apparatus on said bed; said flexible apparatus comprising a bedsore protection pad.

12. A person transfer arrangement comprising the bed having a first sheet of material extending across the bed with first roller means at opposite edges of the bed; a power source to rotate said roller means for pulling said sheet across the mattress by said roller means; a support adjacent to said bed having a second sheet of material extending across it and on which a person may lie; second roller means to move said second sheet of material across said support; means for controllng motion of sheets on said bed and said support to transfer a supine person in either direction between said support and said bed; attachment means on said first sheet for removably fastening a flexible apparatus to said first sheet and drawing up said flexible apparatus on said bed by the moving sheet; means for controlling motion of sheets on the bed and support so that a person may be transported in either direction between said support and said flexible apparatus on said bed; said flexible apparatus comprising a heating pad.

13. A person transfer arrangement comprising a bed having a first sheet of material extending across the bed with first roller means at opposite edges of the bed; a power source to rotate said roller means for pulling said sheet across the mattress by said roller means; a support adjacent to said bed having a second sheet of material extending across it and on which a person may lie; second roller means to move said second sheet of material across said support; means for controlling motion of sheets on said bed and said support to transfer a supine person in either direction between said support and said bed; attachment means on said first sheet for removably fastening a flexible apparatus to said first sheet and drawing up said flexible apparatus on said bed by the moving sheet; means for controlling motion of sheets on the bed and support so that a person may be transported in either direction between said support and said flexible apparatus on said bed; said flexible apparatus comprising a bedsore protection pad covered by a removably attached sheet of material.

14. A person transfer arrangement comprising a bed having a first sheet of material extending across the bed with first roller means at opposite edges of the bed; a power source to rotate said roller means for pulling said sheet across the mattress by said roller means; a support adjacent to said bed having a second sheet of material extending across it and on which a person may lie; second roller means to move said second sheet of material across said uspport; means for controlling motion of sheets on said bed and said support to transfer a supine person in either direction between said support and said bed; attachment means on said first sheet for removably fastening a flexible apparatus to said first sheet and drawing up said flexible apparatus on said bed by the moving sheet; means for controlling motion of sheets on the bed and support so that a person may be transported in either direction between said support and said flexible apparatus on said bed; a storage roller on which said flexible apparatus can be rolled and from which said flexible apparatus can be drawn onto said bed by said first sheet; a clutch and a roller in contact with and rotating in accordance with motion of said first sheet for driving said storage roller.

15. A person transfer arrangement comprising a bed having a first sheet of material extending across the mattress with first roller means at opposite edges of the mattress; a power source to rotate said roller means for pulling said sheet across the bed by said roller means; a support adjacent to said bed having a second sheet of material on which a person may lie; second roller means to move said second sheet of material across said support; means for controlling motion of sheets on the bed and support to transfer a supine person in either direction between said support and said sheet; attachment means on said second sheet for removably fastening a flexible apparatus and drawing the apparatus up on said support by moving said second sheet; means for controlling motion of sheets on said bed and support so that a person may be transported in either direction between said bed and said flexible apparatus on said support; said flexible apparatus comprising a collapsible bathtub.

16. A person transfer arrangement comprising a bed having a first sheet of material extending across the bed with first roller means at opposite edges of the bed; a power source to rotate said roller means for pulling said sheet across the mattress by said roller means; a support adjacent to said bed having a second sheet of material extending across it and on which a person may lie; second roller means to move said second sheet of material across said support; means for controlling motion of sheets on said bed and said support to transfer a supine person in either direction between said support and said bed; attachment means on said first sheet for removably fastening a flexible apparatus to said first sheet and drawing up said flexible apparatus on said bed by the moving sheet; means for controlling motion of sheets on the bed and support so that a person may be transported in either direction between said support and said flexible apparatus on said bed; said first sheet on the bed being moved by being wound and unwound by said first roller means; said flexible apparatus and part of said first sheet being wound on a roller at one edge of said bed; means for controlling motion of rollers on the bed and on the support for transporting a person between said support and an unoccupied portion of said first sheet on the bed.

17. A person transfer arrangement comprising: first and second supports, each having a flexible sheet of material extending across a flat surface on which a person may lie; means for pulling said flexible sheet with said person to and beyond an edge of each said support; means for positioning said second support at an edge of said first support; means for controlling motion of said flexible sheets on said first support and said second support for transporting a person from one said support to the other; means for separately transporting a flexible apparatus onto said second support concurrently with the person for moving the person onto said flexible apparatus.

18. A person transfer arrangement comprising a bed having a first sheet of material extending across the bed with first roller means at opposite edges of the bed; a power source to rotate said roller means for pulling said sheet across the mattress by said roller means; a support adjacent to said bed having a second sheet of material extending across it and on which a person may lie; a second roller means to move said second sheet of material across said support; means for controlling motion of sheets on said bed and said support to transfer a supine person in either direction between said support and said bed; attachment means on said first sheet for removably fastening a flexible apparatus to said first sheet and drawing up said flexible apparatus on said bed by the moving sheet; means for controlling motion of sheets on the bed and support so that a person may be transported in either direction between said support and said flexible apparatus on said bed; said first sheet on the bed being moved by being wound and unwound by said first roller means; said flexible apparatus and part of said first sheet being wound on a roller at one edge of said bed; means for controlling motion of rollers on the bed and on the support for transporting a person between said support and said flexible apparatus on the bed.

19. A bed having a first sheet of material extending thereacross and roller means at opposite edges of the bed; a power source to rotate said roller means for pulling said first sheet across the bed by said roller means; a second sheet of material having four secured opposite edges; said first sheet and said second sheet being rollable and unrollable from said roller means;

attachment means on said first sheet for removably fastening said second sheet of material with said four opposite edges secured to that said first and second sheets maintain a predetermined order and relative positions after being rolled and unrolled from said roller means.

20. A person transfer arrangement comprising a bed having a mattress and a sheet of material extending across the bed with roller means at opposite edges of the bed; a power source to rotate said roller means for pulling said sheet across the mattress by said roller means; a support adjacent to said bed having a support surface on which a person may rest; means for moving said support surface and means for controlling motion of said sheet and said support surface to transfer a person between said support and said bed; means for separately transporting a flexible apparatus onto said bed concurrently with the person for moving the person onto said flexible apparatus.

21. A person transfer arrangement as defined in claim 20, wherein said flexible apparatus is transported onto said bed by unrolling from a roller.

22. A person transfer arrangement comprising a bed having a mattress and a first sheet of material extending across the bed with roller means at opposite edges of the bed; a power source to rotate said roller means for pulling said sheet across the mattress by said roller means; a support adjacent to said bed and having a support sheet of material extending across the support and on which a person may rest; attachment means for removably fastening a second sheet to said first sheet; driving means for moving said support sheet, and means for controlling motion of said first sheet and said support sheet so that a person may be transported between said support and said second sheet on said bed; said first sheet on the bed being moved by being wound and unwound by said roller means; said driving means differing from said roller means; said second sheet and part of said first sheet being wound on a roller at one edge of the bed.

23. A person transfer arrangement as defined in claim 22, wherein said attachment means comprises a fastener forming a closure between surfaces held together after being brought into contact, said fastener becoming opened after said surfaces are pulled apart.

24. A person transfer arrangement as defined in claim 22, including additional fasteners for attaching a third sheet over said second sheet.

25. A person transfer arrangement as defined in claim 22, wherein said first sheet is impermeable and said second sheet is permeable.

26. A person transfer arrangement as defined in claim 22, wherein said second sheet has four edges, two of said edges comprising opposite edges; said attachment means fastening said second sheet at said opposite edges.

27. A person transfer arrangement comprising a bed having a first sheet of material extending across the bed with roller means at opposite edges of the bed; a power source to rotate said roller means for pulling said sheet across the mattress by said roller means; a support adjacent to said bed having a support surface on which a person may lie; attachment means for removably fastening a second sheet to said first sheet; means for moving said support surface and means for controlling motion of said first sheet and said support surface so that a person may be transported between said support and said second sheet on said bed; said first sheet on the bed being moved by being wound and unwound by said roller means; said support surface being moved differently from said sheet; said second sheet and part of said first sheet being wound on a roller at an edge of said bed.

28. A person transfer arrangement comprising a bed having a mattress and a first sheet of material extending across the bed with first roller means at opposite edges of the bed; a power source to rotate said roller means for pulling said first sheet across the mattress by said roller means; a support adjacent to said bed and having a supporting sheet of material extending across the support and on which a person may rest; means for moving said support sheet and means for controlling motion of said first sheet and said support sheet to transfer a person between said support and said bed; attachment means on said first sheet for removably fastening a flexible apparatus to said first sheet; said flexible apparatus being separate from said person and said support; means for controlling motion of said sheets on the bed and the support so as to draw up said flexible apparatus on said bed and concurrently transport said person onto said flexible appartus on said bed; said first sheet on the bed being moved by being wound and unwound by said first roller means; said flexible apparatus and part of said sheet being wound on a roller at one edge of said bed; and means for controlling motion of the first sheet and the support sheet for transporting a person between said support and said flexible apparatus.

29. A person transfer arrangement comprising a bed having a sheet of material extending across the bed with roller means at opposite edges of the bed; a power source to rotate said roller means for pulling said sheet across the mattress by said roller means; a support adjacent to said bed and having a support surface on which a person may rest; means for moving said support surface and means for controlling motion of said sheet and said support surface to transfer a person between said support and said bed; attachment means on said sheet for removably fastening a flexible apparatus to said sheet; said flexible apparatus being separate from said person and said support surface; means for controlling motion of said sheet and said support surface so as to draw said flexible apparatus on said bed and concurrently transport said person onto said flexible apparatus on said bed; said sheet being moved by being wound and unwound by said roller means; said flexible apparatus and part of said sheet being wound on a roller at one edge of said bed; and means for controlling motion of said rollers and said support surface for transporting a person between said support and said flexible apparatus.

* * * * *